United States Patent [19]

Hammond et al.

[11] 4,257,658

[45] Mar. 24, 1981

[54] CABLE SHIELD CONNECTOR ASSEMBLY

[76] Inventors: Daniel L. Hammond, 123 S. Main, Windsor, Mo. 65360; Philip G. Jeffries, #2 O'Donnel Ct., Little Rock, Ak. 72204

[21] Appl. No.: 36,549

[22] Filed: May 7, 1979

[51] Int. Cl.[3] ..... H01R 4/66

[52] U.S. Cl. ..... 339/14 R; 174/78; 339/95 D; 339/230 R

[58] Field of Search ..... 339/13, 14 P, 14 R, 339/14 L, 95 D, 96, 230 R, 226, 264 R; 174/78

[56] References Cited

U.S. PATENT DOCUMENTS

| | | | |
|---|---|---|---|
| 2,769,964 | 11/1956 | Lartz | 339/230 X |
| 3,568,128 | 3/1971 | Taylor | 339/14 R |
| 3,753,204 | 8/1973 | Thompson et al. | 339/14 R |
| 3,757,269 | 9/1973 | Baumgartner et al. | 339/14 L |
| 3,778,749 | 12/1973 | Kapell | 174/78 |
| 3,887,895 | 6/1975 | Pierzchala | 339/14 R |
| 4,080,024 | 3/1978 | Kroom | 339/14 R |
| 4,106,832 | 8/1978 | Burns | 339/14 L |
| 4,176,893 | 12/1979 | Olszewski et al. | 339/14 R |

*Primary Examiner*—John McQuade
*Assistant Examiner*—DeWalden W. Jones
*Attorney, Agent, or Firm*—Fishburn, Gold & Litman

[57] ABSTRACT

A cable shield connector assembly for making electrical connections to the shield of a multi-conductor communications-type cable includes a split cylindrical sleeve having circumferentially spaced contact ridges for insertion about the conductors and within the shield and further includes clamp halves positioned about the sleeve with a portion of the shield and the external insulation sheath of the cable therebetween. The clamp halves are drawn together by screws to urge the shield into electrical contact with the ridges of the sleeve. The sleeve includes a tab projecting through a slit in the shield and sheath to receive a screw for connection of a ground conductor thereto. The tab preferably extends between a portion of the clamp and receives one of the clamping screws therethrough to thereby locate and fix the clamp halves around the sleeve.

10 Claims, 6 Drawing Figures

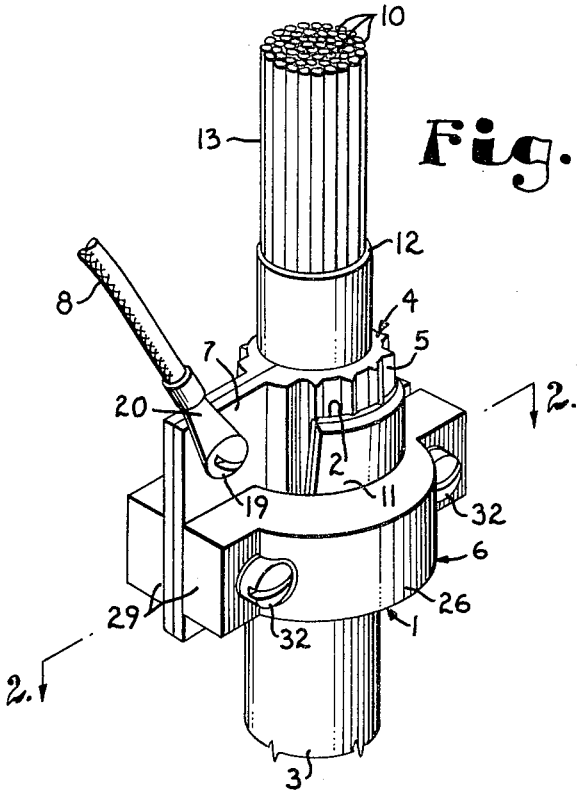
Fig. 1.
Fig. 2.
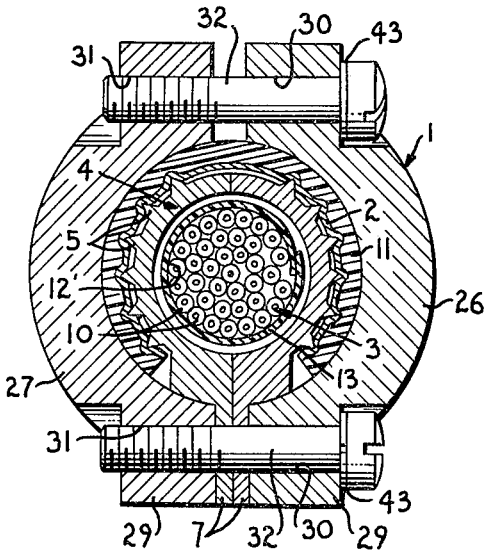
Fig. 3.
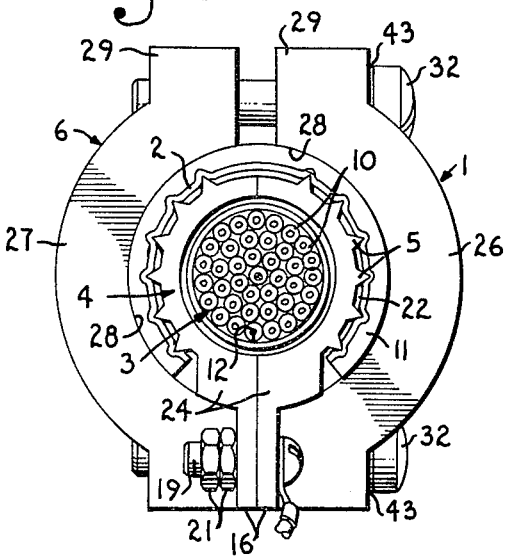
Fig. 6.
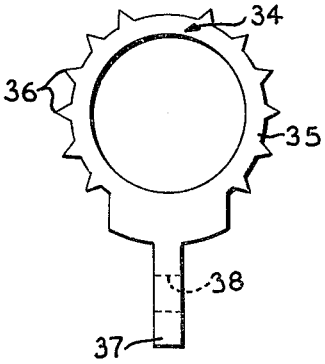

CABLE SHIELD CONNECTOR ASSEMBLY

FIELD OF THE INVENTION

The present invention relates to cable shield connectors and more particularly to such a connector including a sleeve with contact ridges and adapted for insertion beneath the shield and an encircling clamp to force the shield into contact with the ridges.

BACKGROUND OF THE INVENTION

Communication cables, such as telephone cables, commonly comprise a plurality of insulated conductors surrounded by a metallic shield and an outer insulation sheath. The conductor may be grouped in a plurality of bundles or a single bundle, and the cable may include an inner insulation sheath between the bundles and the shield. The shield is normally connected to ground in order to minimize the introduction of ambient electrical "noise" into the information carrying conductors and also for protection against lightening. When two cables are spliced together, it is necessary to make a reliable connection between the shields thereof in order for both of the shields to be electrically functional. In some circumstances it might be desirable to provide a connection of the shield of a cable to ground at a section of the cable remote from a severed end. Since many such connections to cable shields are made in the field, away from sources of electrical power for soldering irons, such connections are generally solderless, instead, employing mechanical connector devices.

Heretofore, cable shield connector devices have consisted of arrangements such as toothed clamp jaws wherein one jaw is inserted between the shield and the conductor bundle and the other jaw is placed on the outside. The jaws are drawned together by means of a bolt and nut. The bolt is generally attached to the inserted jaw thereby requiring a hole or a slot to be punched or cut in the sheath and shield. A ground conductor is connected to the assembly, usually by means of a screw lug received on the bolt. Care must be taken in handling the cable and ground conductor to avoid tearing the shield and sheath, since the clamping stresses are concentrated on one side of the cable.

Another type of connector employs a hose-type clamp in place of the outside jaw to urge the shield into contact with the jaw or plate inserted under the shield. Such constricting stress is likely to drive the inserted jaw into the conductor bundle, damaging same, and may possibly interfer with the flow of gas employed in the bundles of some cables to prevent the entry of moisture.

The connector of the present invention avoids the foregoing problems by means of a sleeve having ridges to make good contact with the shield and which prevents the transfer of the force of the clamp used therewith to the conductor bundle.

SUMMARY OF THE INVENTION

The principal objects of the present invention are: to provide an improved assembly for making solderless connections to the shield of a cable; to provide such an assembly which makes good electrical contact with the shield; to provide such an assembly which is capable of cutting through a plastic coating provided on some shields; to provide such an assembly which evenly distributes stress applied to the cable for making a solderless connection thereto; to provide such an assembly including a sleeve having axially oriented contact ridges, the sleeve being inserted in surrounding relation to conductors of the cable and within the shield and including a clamp to urge the shield into electrical contact with the ridges; to provide such an assembly wherein the sleeve is substantially rigid to avoid deformation of the conductors by the force of the clamp; to provide such an assembly which may be employed adjacent and end of the cable or remote therefrom; and to provide such an assembly which is economical to manufacture, convenient to install, durable and effective in service, and which is particularly well adapted for its intended purpose.

Other objects and advantages of this invention will become apparent from the following description taken in connection with the accompanying drawings wherein are set forth, by way of illustration and example, certain embodiments of the cable shield connector.

BRIEF DESCRIPTION OF THE DRAWINGS

FIG. 1 is a perspective view of the cable shield connector of the present invention shown installed on the end of a multi-conductor cable.

FIG. 2 is an enlarged transverse sectional view taken on line 2—2 of FIG. 1.

FIG. 3 is an end elevational view of the cable with the cable shield connector thereon and showing connection of a ground conductor to the cable shield connector.

FIG. 6 is an end elevational view of a modified one-piece sleeve for use with the cable shield connector assembly.

DESCRIPTION OF THE PREFERRED EMBODIMENTS

Figure 4:
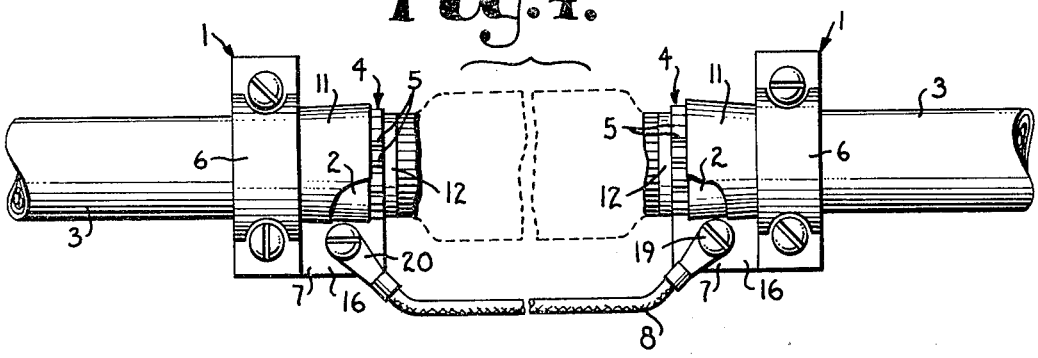
FIG. 4 is a plan view at a reduced scale showing a pair of cables spliced together and showing the interconnection of the respective shields thereof by means of cable shield connectors according to the present invention.

The reference numeral 1 generally designates a cable shield connector assembly for making connections to the shield 2 of a multi-conductor communication type cable 3. The connector assembly 1 generally comprises a sleeve 4 having contact point means or ridges 5 for insertion underlying the shield 2; and an encircling clamp 6 received externally on the cable 3 in surrounding relation to the sleeve 4 for urging the shield 2 into electrical contact with the ridges 5 of the sleeve 4. The sleeve 4 includes terminal means 7 to receive a conductor 8 in electrical contact therewith for making connections to the shield 2 by way of the sleeve 4.

The cable 3 is a conventional communications-type cable, such as a telephone cable, having a plurality of elongated, individually insulated, information carrying conductors 10; the shield 2 surrounding the conductors 10 and extending along the length of the cable 3; and an external protective insulation sheath 11 surrounding the shield 2. The cable 3 may include an inner insulation sheath 12 surrounding the conductors 10, underlying the shield 2, and forming a bundle 13 of the conductors 10. In some kind of cables, particularly cables having a great number of individual conductors thereof, said conductors may be grouped in a plurality of bundles 13. In the embodiments illustrated, a single bundle 13 is represented for simplicity. In some environments, the inner sheath 12 comprises a conduit into which an inert gas is introduced under a slight pressure in order to prevent the entry of moisture thereinto. In such a case, it is necessary for the inner sheath 12 to be continuous and sealed as shown in FIG. 3; otherwise, the inner sheath may be simply wrapped around the bundle 13, as shown at 12' in FIG. 2.

Figure 5:
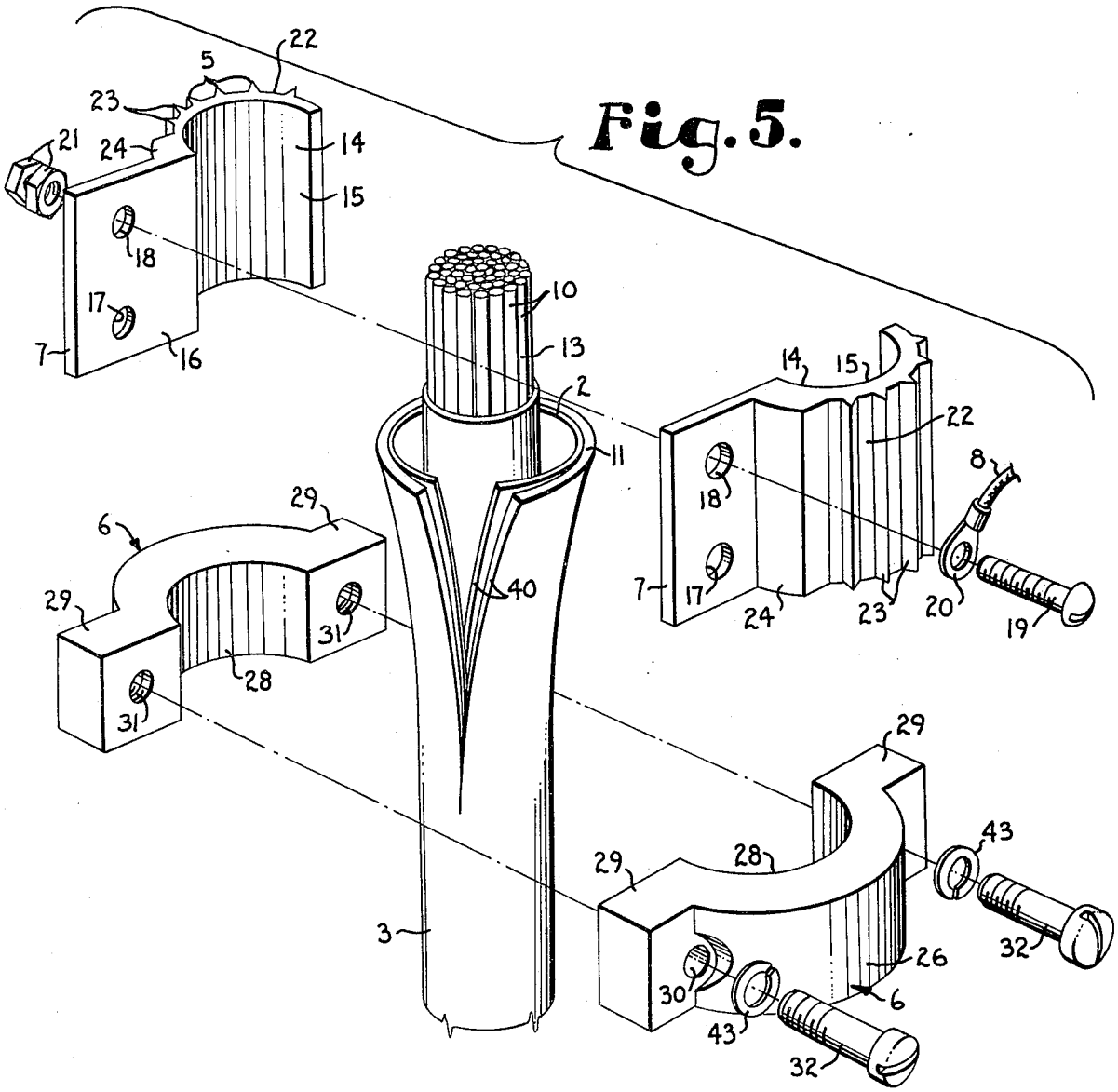
FIG. 5 is an exploded perspective view of the parts of the cable shield connector.

Referring to FIG. 5, for convenience of installation, the sleeve 4 consists of a pair of sleeve halves 14. Each sleeve half 14 includes a half cylindrical or semi-annular shell 15 having an inner diameter slightly greater than the diameter of the bundle 13 of the particular cable 3 with which the connector assembly 1 is to be used. The sleeve halves 14 may employ some means for maintaining proper registry thereof when assembled on the cable 3. In the illustrated embodiment, each sleeve half 14 includes an outwardly projecting tab 16 having at least one aperture 17 formed therein. The apertures 17 of a corresponding pair of sleeve halves 14 are alignable to receive a fastener therethrough to maintain the halves 14 in proper registry. The tabs 16 may be employed as the terminal means or terminal 7 to provide for connection of the ground conductor 8 to the sleeve 4. Therefore, the tabs 16 include a second pair of alignable apertures 18 to receive a fastener, such as a screw 19, for connecting a screw lug 20 of the ground conductor 8 to the sleeve 4. The screw 19 may be secured on the tab 16 by means such as a pair of nuts 21.

In order to make good contact with the shield 2, sleeve 4 includes the point means or ridges 5 which are distributed over a substantial portion of the outer surfaces 22 of the cylindrical shells 15. Preferably, the ridges 5 extend parallel to the axis of the cylindrical shells 15 in order to facilitate insertion of the sleeve 4 beneath the shield 2. Since the shield 2 on some cables includes a protective plastic coating (not shown), it is desirable for the ridges 5 to be sharp enough to cut through the coating but blunt enough to avoid damaging the shield 2. Where the assembly 1 is not to be used on a cable having such a coating, the ends 23 of the ridges 5 may be chamfered (not shown) in order to reduce the potential thereof for snagging and to further facilitate insertion of the sleeve beneath the shield. Preferably, the sleeve 4 is reinforced at the transition between the shell 15 and tab 16. The reinforcement 24 may be an extra thickness of material, or the transition be simply the radius.

The sleeve 4 should be substantially rigid to avoid deformation of the bundle 13 from the stress of the clamp 6 and should be highly conductive in order to provide for efficient contact with the shield 2. Therefore, the sleeve 4 is preferably formed of aluminum or tin plated brass by extrusion or die casting.

The clamp 6 may be any type of clamp which is operative to urge the shield 2 into good electrical contact with the ridges 5 of the sleeve 4. In the illustrated embodiments, the clamp 6 comprises a pair of clamp halves 26 and 27, each half having an arcuate recess 28 sized to encompass the particular cable 3 with the sleeve 4 inserted therein. The illustrated clamp halves 26 and 27 include outwardly projecting lugs 29 having bores 30 and 31 respectively formed therethrough to receive fasteners, such as screws 32, therein to urge the clamp halves 26 and 27 together. Preferably, the bores 30 of one of the clamp halves, such as clamp half 27, are passed to threadably receive the screws 31 therein. The clamp halves 26 and 27 are formed from a sturdy material, such as aluminum, by conventional process.

FIG. 6 illustrates a modified sleeve 34 for use with the cable shield connector assembly 1. In contrast to the sleeve 4 which is formed in halves 14, the modified sleeve 34 is an integral member and includes a cylindrical shell 35 having contact ridges 36 distributed about the external surface of the shell 35 and an outwardly projecting tab 37 having apertures 38 formed therethrough. The ridges 36, tab 37, and apertures 38 are substantially similar respectively to the ridges 5, tabs 16, and apertures 17 and 18 of the preferred sleeve 4. Installation of the modified sleeve 34 is substantially similar to that of the sleeve 4, except that the modified sleeve 34 must be employed adjacent an end of a severed cable whereas the sleeve 4 may also be employed remote from a severed end of a cable.

Referring to FIGS. 4 and 5, a pair of cables 3 are prepared for splicing by stripping or removing a length of the outer sheath 11 and shield 2 to expose the bundle 13 of conductors 10. A shorter section of the inner sheath 12, if present, is also stripped away. A slit 40 is cut lengthwise in the ends 41 of the sheath 11 and shield 2 in order to provide clearance for the projecting tabs 16 and to allow for some diametric expansion of the sheath and shield to receive the sleeve 4 therein. If the modified sleeve 34 is to be employed, a sleeve 34 is sleeved onto the bundle 13 of each cable and is slid under the shield 2 with the tab 37 thereof projecting from the slit 40. However, if the preferred two-piece sleeve 4 is to be employed, installation thereof may be delayed until after the individual conductors have been spliced. After the conductors 10 has been suitably matched and joined, the shields 2 of the cables 3 are interconnected by installation of a cable shield connector assembly 1 on each of the cables 3.

On each of the cables 3, a pair of the sleeve halves 14 are placed on opposite sides of the bundle and in surrounding relation thereto and slid beneath the shield 2 such that the halves are mated together and the tabs 16 thereof project from the slit 40. The clamp halves 27 and 28 are then placed on the cable in surrounding relation to the sleeve 4, with the bores 30 and 31 on one side aligned with the aperture 17 of the tab 16 and with the bores of the other side mutually aligned. The screws 32 are inserted through suitable lock washers 43, through the bores 30 of the clamp halves 26 and threaded into the threaded bores 31 of the clamp half 27, and tightened to urge the shield into electrical contact with the ridges 5 of the sleeve 4. At such time, it is advisable to check for electrical continuity between the sleeve 4 and the shield 2 if the shield 2 includes an insulation coating thereon. After the sleeve 4 and clamp 6 have been installed on each cable, the shields may be interconnected by attachment of the ground conductor 8 to each of the remaining apertures 18 of the tabs 16. Finally, the entire splice, including the two connector assemblies 1 may be encased in a protective housing, shroud, or the like (not shown) to prevent damage thereto and the entry of moisture thereinto.

The cable shield connector assembly 1 may also be used for making a ground connection to the shield 2 of a cable remote from a severed end thereof, in much the same manner as described above. However, the slit 40 must be somewhat longer, and the clamp halves 14 of the preferred two-piece sleeve 4 must be inserted one at a time and manipulated into the proper mutual relationship.

While certain forms of the invention have been described and illustrated, it is not to be limited thereto except insofar as such limitations are included in the following claims.

What is claimed and desired to secure by Letters Patent is:

1. A cable shield connector assembly for a cable having a ground shield surrounding a bundle of insulated conductors and an external insulation sheath surrounding said shield, said assembly comprising:

(a) conductive sleeve means for insertion into surrounding relation to said bundle and within said shield;

(b) outwardly directed ridges integral with said sleeve means and distributed over a substantial circumferential portion of the outer surface of said sleeve means;

(c) clamp means for positioning on said cable surrounding said sleeve means with a portion of said shield and said sheath between said sleeve means and said clamp means to thereby urge said shield into electrical contact with said ridges; and (d) terminal means on said sleeve means to receive a ground conductor for electrical communication with said shield by way of said sleeve means.

2. An assembly as set forth in claim 1 wherein said sleeve means includes: a pair of half cylindrical shells forming a cylindrical sleeve when suitably mated.

3. An assembly as set forth in claim 1 wherein: said sleeve means is substantially rigid to thereby prevent deformation of said bundle by said clamp means.

4. An assembly as set forth in claim 1 wherein said clamp means includes:

(a) a pair of clamp halves;

(b) each clamp half having an arcuate recess to receive said cable therein;

(c) each clamp half having an outwardly projecting fastener receiving lug one each side of said recess; and (d) fastener means for engagement with respective lugs of said clamp halves to thereby urge said halves into clamping contact with said cable.

5. An assembly as set forth in claim 4 wherein:

(a) said projections include respectively alignable fastener receiving bores therethrough;

(b) said fastener means comprises features receivable respectively in the aligned bores of the lugs on each side of said clamp means;

(c) said sleeve means includes a tab projecting outwardly therefrom and through said shield and sheath, said tab having a fastener receiving aperture therethrough; and (d) said tab is positioned between the lugs on one side of said clamp means, said aperture being aligned with the bores on said one side and receiving one of said fasteners therethrough to thereby locate and fix the position of said clamp means in surrounding relation to said sleeve means.

6. An assembly as set forth in claim 5 wherein: said tab includes a second aperture therethrough to receive means to connect said ground conductor thereto.

7. An assembly as set forth in claim 1 wherein:

(a) said terminal means comprises a tab projecting outwardly from said sleeve means through said shield and sheath; and (b) said tab includes means thereon to receive said ground conductor in electrical connection therewith.

8. In combination: a cable having a shield surrounding a bundle of insulated conductors and an insulation sheath surrounding said shield; and a cable shield connector assembly, said assembly comprising:

(a) conductive sleeve means inserted in surrounding relation to said bundle and within said shield;

(b) outwardly directed contact ridges integral with said sleeve means and distributed over a substantial circumferential portion of the outer surface thereof;

(c) clamp means positioned on said cable surrounding said sleeve means with a portion of said shield and said sheath therebetween to thereby urge said shield into electrical contact with said ridges; and (d) terminal means on said sleeve, said terminal means being accessible to receive a ground conductor for electrical communication with said shield by way of said sleeve means.

9. A cable shield connector assembly for a cable having a ground shield surrounding a bundle of insulated conductors and an external insulation sheath surrounding said shield, said assembly comprising:

(a) conductive sleeve means for insertion into surrounding relation to said bundle and within said shield;

(b) outwardly directed point means integral with said sleeve means and distributed over a substantial portion of the outer surface of said sleeve means; said point means including axially extending ridges spaced cicumferentially about said outer surface of said sleeve means;

(c) clamp means for positioning on said cable surrounding said sleeve means with a portion of said shield and said sheath between said sleeve means and said clamp means to thereby urge said shield into electrical contact with said point means; and (d) terminal means on said sleeve means to receive a ground conductor for electrical communication with said shield by way of said sleeve means.

10. In combination: a cable having a shield surrounding a bundle of insulated conductors and an insulation sheath surrounding said shield; and a cable shield connector assembly, said assembly comprising:

(a) conductive sleeve means inserted in surrounding relation to said bundle and within said shield;

(b) outwardly directed contact point means integral with said sleeve means and distributed over a substantial portion of the outer surface thereof; said point means including axially extending ridges spaced circumferentially about said outer surface of said sleeve means;

(c) clamp means positioned on said cable surrounding said sleeve means with a portion of said shield and said sheath therebetween to thereby urge said shield into electrical contact with said point means; and (d) terminal means on said sleeve, said terminal means being accessible to receive a ground conductor for electrical communication with said shield by way of said sleeve means.

* * * * *